US007456728B2

(12) United States Patent
Huang

(10) Patent No.: US 7,456,728 B2
(45) Date of Patent: Nov. 25, 2008

(54) FIRE-ALARM CONTROL PANEL HAVING POWER FREQUENCY CARRIER

(75) Inventor: Yuan-Yu Huang, Taipei (TW)

(73) Assignee: Hansder Engineering Co., Ltd., Xinyl District, Taipei (TW)

( * ) Notice: Subject to any disclaimer, the term of this patent is extended or adjusted under 35 U.S.C. 154(b) by 119 days.

(21) Appl. No.: 11/480,437

(22) Filed: Jul. 5, 2006

(65) Prior Publication Data

US 2007/0046440 A1 Mar. 1, 2007

(51) Int. Cl.
*G08B 17/00* (2006.01)

(52) U.S. Cl. ..... 340/286.05; 340/506; 340/525

(58) Field of Classification Search ..... 340/332, 340/333, 506, 525, 532.17, 539.16, 310.11, 340/310.16
See application file for complete search history.

(56) References Cited

U.S. PATENT DOCUMENTS

| | | | | |
|---|---|---|---|---|
| 5,650,762 | A * | 7/1997 | Takahashi et al. | 340/286.05 |
| 6,960,987 | B2 * | 11/2005 | Dohi et al. | 340/286.05 |
| 7,057,517 | B1 * | 6/2006 | Convery | 340/628 |
| 7,075,444 | B2 * | 7/2006 | Tanguay | 340/628 |
| 7,102,504 | B2 * | 9/2006 | Kates | 340/521 |
| 7,271,704 | B2 * | 9/2007 | McSheffrey et al. | 340/286.05 |
| 2003/0052770 | A1 * | 3/2003 | Mansfield et al. | 340/310.01 |

* cited by examiner

*Primary Examiner*—Brent Swarthout
(74) *Attorney, Agent, or Firm*—Troxell Law Office, PLLC

(57) ABSTRACT

A fire-alarm control panel uses a transforming unit together with indoor power line for a fire alarm; and a signal for the fire alarm is transferred to another fire-alarm control panel in another place.

10 Claims, 4 Drawing Sheets

FIRE-ALARM CONTROL PANEL HAVING POWER FREQUENCY CARRIER

FIELD OF THE INVENTION

The present invention relates to a fire-alarm control panel; more particularly, relates to alarming for a fire and transferring the alarm signal for the fire between at least two areas.

DESCRIPTION OF THE RELATED ART(S)

A general prior art, "A fire-alarm device", is disclosed in China, as shown in FIG. 4. The device comprises a case having a rechargeable battery 6, an automatic switch 60, at least one manual switch 61 and a fire alarm device, where the rechargeable battery 6 is connected with an AC (alternating current) power resource; the automatic switch 60 is connected to an output of the battery 6; the automatic switch 60 and the at least one manual switch 61 are connected in a parallel way; the fire alarm device is connected to an output of each switch 60, 61; the fire alarm device comprises an audio device 62 and a controller 63; and the audio device 62 and the controller 63 are connected in a parallel way. The device can send an alarm for a fire to everywhere in an environment in a few seconds even when the power system is destroyed or the audio and video device is inactive; and, so, people in dangerous areas can be evacuated to flee for their lives.

Although the above fire-alarm device can send an alarm for a fire in a few seconds even when the power system is destroyed or the audio and video device is inactive, the prior art can set in a building only, which can not send the fire-alarm signal to the fire brigade and/or the police department. Consequently, although people in the building having a fire can escape out of the fire, inhabitants lived nearby the building may be caught by the fire and not able to flee for their lives owing to a lack of the fire alarm or owing to being late for notifying police officers and firefighters. So, the prior art does not fulfill users' requests on actual use.

SUMMARY OF THE INVENTION

Therefore, the main purpose of the present invention is to utilize a transforming unit coordinated with indoor power line for fire alarm as well as for transferring fire-alarm signal between at least two main signal control panels for different areas.

To achieve the above purpose, the present invention is a fire-alarm control panel having power frequency carrier, comprising a main signal control panel, at least one detecting unit, at least one warning unit, an indoor power unit and an emergency power unit, where the main signal control panel comprises a signal T/R (transferring/receiving) unit and a transforming unit; the transforming unit comprises a single-chip control module, a power carrier module, a signal I/O (input/output) module and a power I/O module; the signal T/R unit of the main signal control panel is connected with the signal I/O module of the single-chip control module; the detecting unit and the warning unit are connected with the signal T/R unit; and the indoor power unit and the emergency power unit are connected with the power I/O module. Accordingly, a novel fire-alarm control panel having power frequency carrier is obtained.

BRIEF DESCRIPTIONS OF THE DRAWINGS

The present invention will be better understood from the following detailed description of the preferred embodiment according to the present invention, taken in conjunction with the accompanying drawings, in which FIG. 1 is a block view showing a preferred embodiment according to the present invention;

DESCRIPTION OF THE PREFERRED EMBODIMENT

The following description of the preferred embodiment is provided to understand the features and the structures of the present invention.

Figure 1:
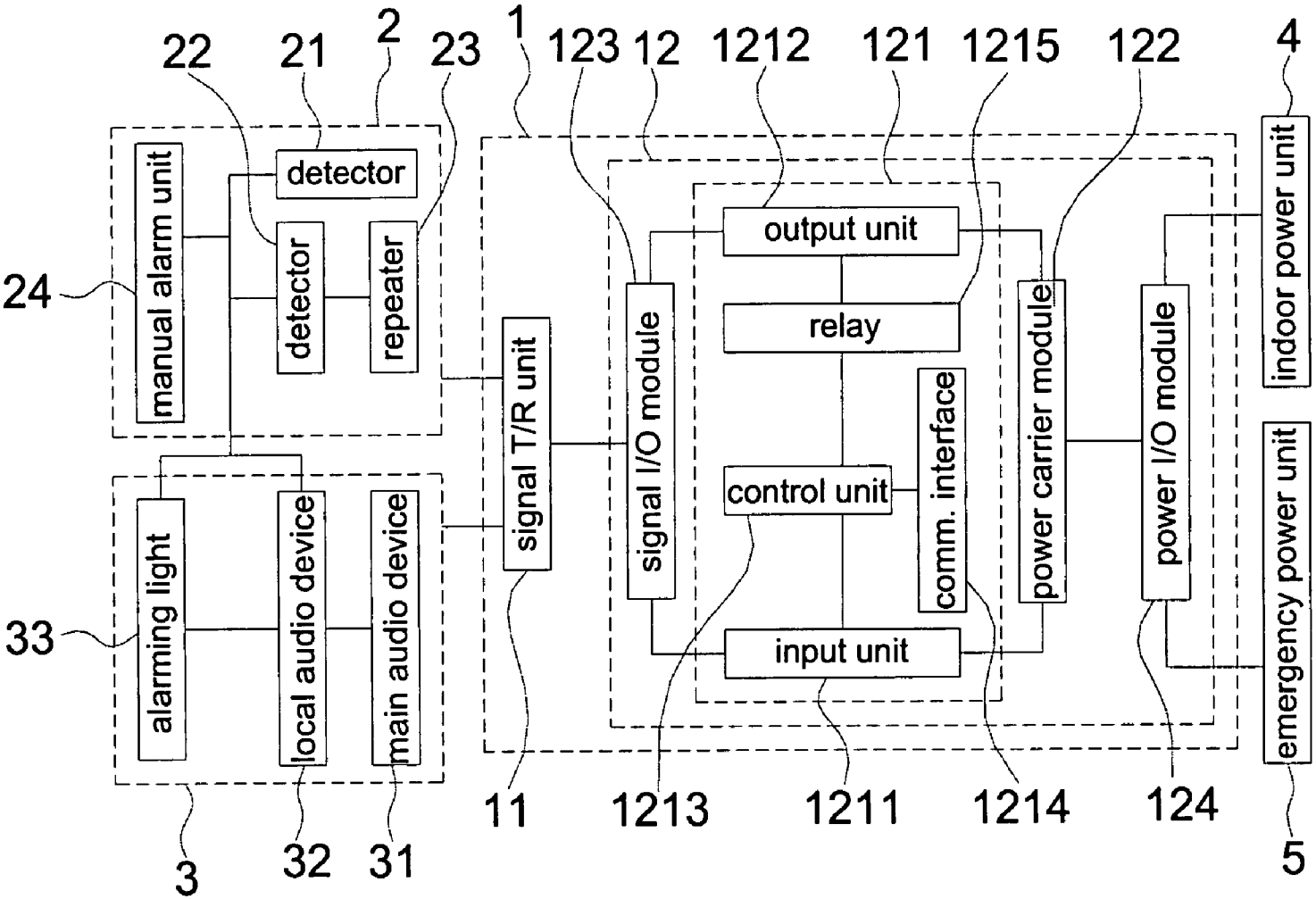

Please refer to FIG. 1, which is a block view showing a preferred embodiment according to the present invention. As shown in the figure, the present invention is a fire-alarm control panel having power frequency carrier, comprising a main signal control panel 1, at least one detecting unit 2, at least one warning unit 3, an indoor power unit 4 and an emergency power unit 5.

The main signal control panel 11 comprises a signal T/R (transferring/receiving) unit 11 and a transforming unit. The transforming unit 12 comprises a single-chip control module 121, a power carrier module 122 with a transferring rate of 1200 BPS (bit per second), a signal I/O (input/output) module 123 and a power I/O module 124, where the signal I/O module 123 is connected to the signal T/R (transferring/receiving) unit 11. The single-chip control module 121 comprises an in put unit 1211, an output unit 1212, a control unit 1213, a communication interface 1214 and a relay 1215. The control module 1213 is a 8051 single-chip processor having excellent inner structure with a working frequency up to 16 MHz, comprising a 4 k size of electrically programmable and erasable ROM (Read Only Memory), and eight input pins and eight output pins. The relay 1215 is located at the output pins of the single-chip control module 121 to quarantine the circuit for securing and ensuring the operation of the single-chip control module 121. The 8051 single chip contains a full-duplex communication interface 1214 inside. The communication interface 1214 can be an RS232 interface to transfer and receive data simultaneously from outside. Because the operational signals are on a TTL (transistor-transistor-logic) level (0 voltage set as logic 0; +5 voltage set as logic 1) and the communication interface 1214 is a serial communication interface to transfer or receive data in a form of series of bits, linkages can be easily established between controllers (such as absorbing carrier, auto-detecting device, etc.), apparatuses and computers.

Each detecting unit 2 is connected to the signal T/R unit 11 of the main signal control panel 1 to transfer signals detected from outside to the signal T/R unit 11. The detecting unit 2 comprises at least one detector 21, 22, at least one repeater 23 and at least one manual alarm unit 24, where the repeater 23 is located between the detector 22 and the main signal control panel 11.

Each warning unit 3 is connected with the signal T/R unit 11 of the main signal control panel 1, comprising a main audio device 31, at least one local audio device 32 and at least one alarming light 33.

The indoor power unit 4 is connected with the power I/O module 124 of the transforming unit 12 and comprises a plug for indoor power.

The emergency power unit 5 is connected with the power I/O module 124 of the transforming unit 12. With the above structure, a novel fire-alarm control panel having power frequency carrier is obtained.

Figure 2:
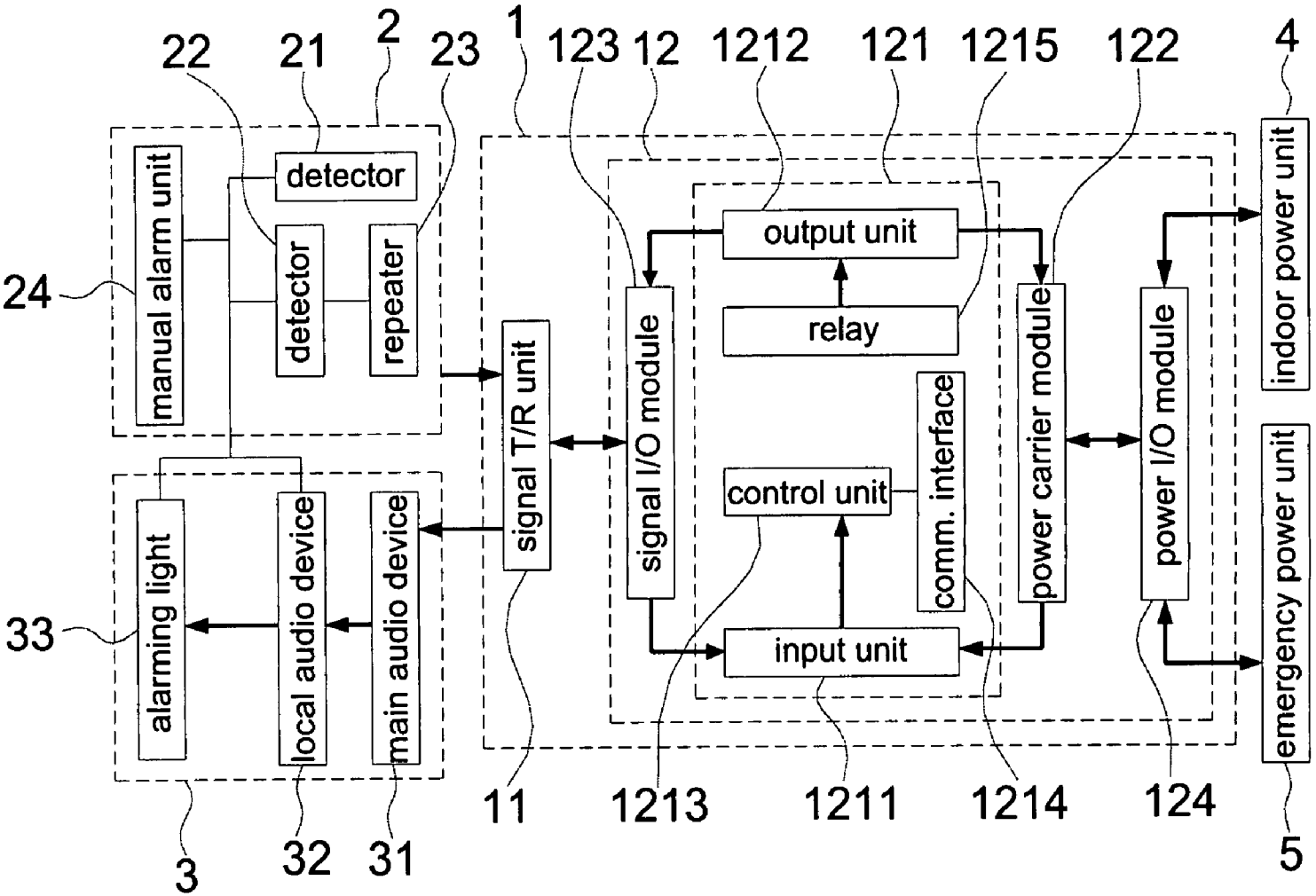
FIG. 2 is a block view showing a state of use of the preferred embodiment according to the present invention.
Figure 3:
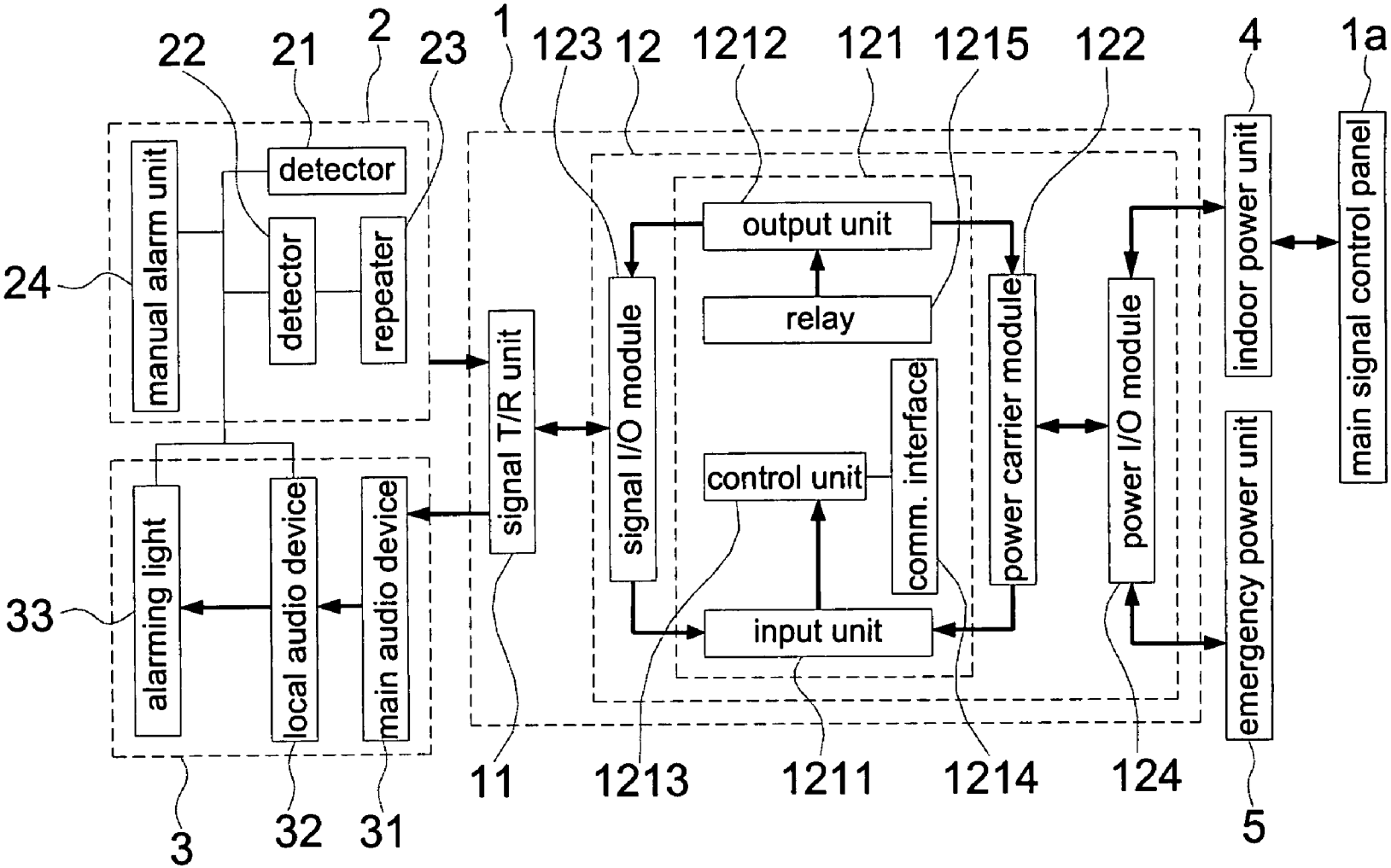
FIG. 3 is a block view showing another state of use of the preferred embodiment according to the present invention.
Figure 4:
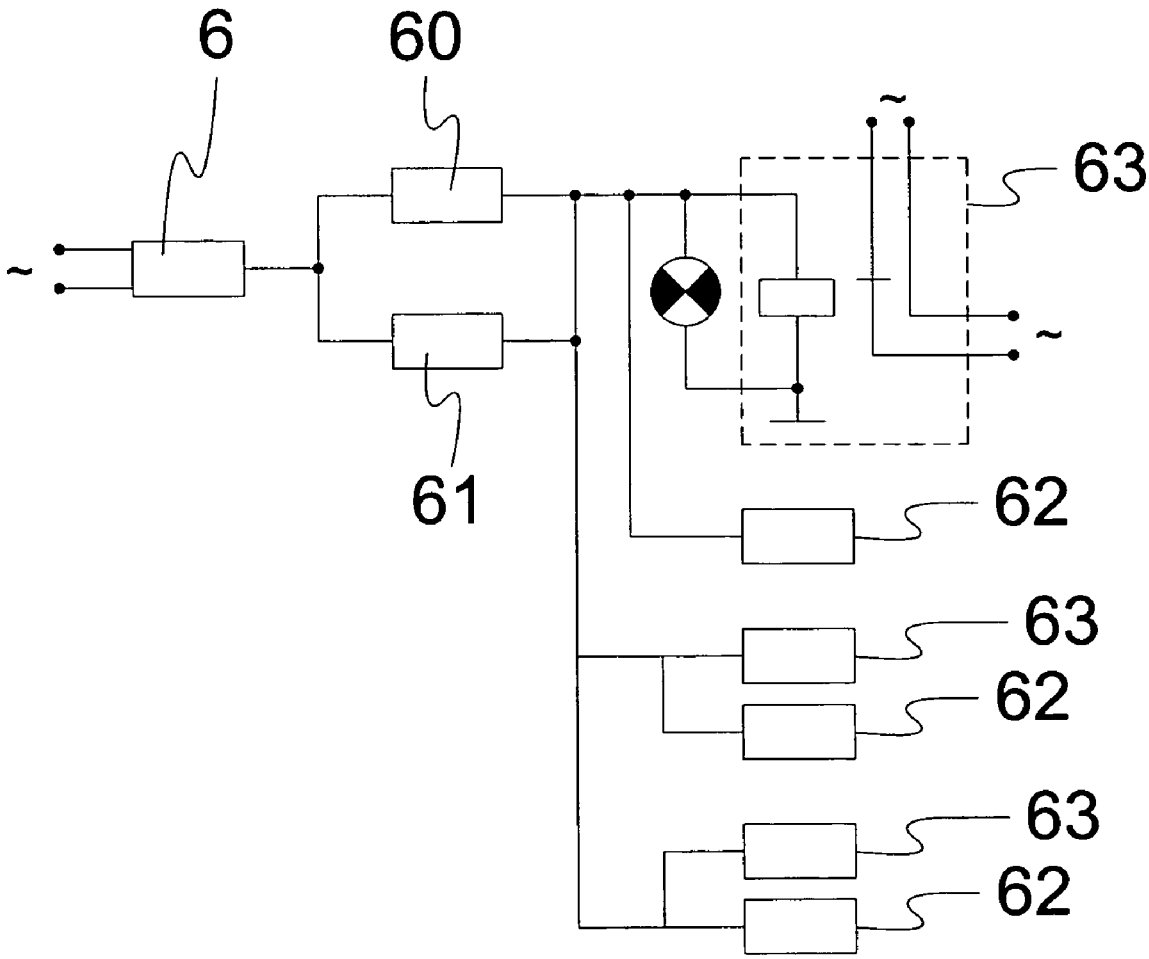
FIG.4 (Prior art)
FIG. 4 is a structural view of a prior art.

Please refer to FIG. 2 and FIG. 3, which are block views showing two states of use of the preferred embodiment according to the present invention. As shown in the figures, the present invention can be applied to different buildings in a community or in different communities to transfer fire-alarm signals in the buildings. For example, when two main signal control panels 1, 1*a* are connected with each other, at least one detector 21, 22, at least one manual alarm unit 24, at least one local audio device 32 and at least one alarming light 33 are set in required places in a building; the main signal control panels 1, 1*a* are set in default places (such as guard rooms, fire brigades and police department in the buildings; a main audio devices 31 are set in the default places set with the main signal control panels 1, 1*a*; and, indoor power units 4 of the main signal control panels 1, 1*a* are plugged to indoor power circuits. By doing so, the main signal control panels 1, 1*a* are installed.

What follows are the effects the present invention can achieve. Yet, because the technologies for signal transference and wiring between the main signal control panel 1, detecting unit 2 and warning unit 3 are well-known, the description concerning these technologies is omitted.

When the present invention is used and the detector 21, 22 detects a heat source, a smoke or a fire, or a person turns on the manual alarm unit 24 owing to finding a fire, a fire-alarm signal is immediately sent to the main signal control panel 1 deposed in a control room through a signal T/R unit 11 of the main signal control panel 1 together with an alarm sound made by the main audio device 31 of the warning unit 3. At the same moment, the local audio device 32 and the alarming light 33 of the warning unit 3 are actuated to notify members in the building to put out the fire and/or flee for their lives. After the main signal control panel 1 receives the fire-alarm signal, the fire-alarm signal can be transferred to another main signal control panel 1*a*. Therein, the signal is outputted from the signal T/R unit 11 of the main signal control panel 1 to an input unit 1211 of a single-chip control module 121 through a signal I/O module 123 of a transforming unit 12. After the input unit 1211 of the single-chip control module 121 has received the signal, the signal is then transferred to an output unit 1212 through a control unit 1213 and a relay 1215 in the single-chip control module 121. Then, the signal is transferred to a power carrier module 122 of the transforming unit 12 from the output unit 1212. After being modulated in the power carrier module 122, the signal is transferred to a power I/O module 124 of the transforming unit 12 and is further transferred to the another main signal control panel 1*a* deposed in another control room through indoor power circuit coordinated with an indoor power unit 4. Thus, a guard in the another control room, or a police officer or a firefighter, can be notified with a fire for a better counter plot of immediately warning and evacuating nearby inhabitants to prevent bigger disaster from the fire.

Besides, when electric power is cut by the fire, an emergency power unit 5 can be a replacement for the indoor power unit 4 to supply power required by the main signal control panel, the detecting unit 2 and the warning unit 3; and so, regulations and lows can be complied with and requirements of use can be met.

To sum up, the present invention is a fire-alarm control panel having power frequency carrier, which utilizes a transforming unit together with indoor power line for fire alarm and transfers fire-alarm signals between at least two building in at least one community.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A fire-alarm control panel having power frequency carrier, comprising:

a main signal control panel comprising a signal T/R (transferring/receiving) unit and a transforming unit, said transforming unit comprising a signal I/O (input/output) module, a single-chip control module, a power carrier module and a power I/O module, said signal I/O module connecting to said signal T/R unit, wherein said power carrier module is configured to modulate an alarm signal and then transfer said alarm signal to said power I/O module, said power I/O module being configured to transfer said alarm signal to another, remotely located fire-alarm control panel;

at least one detecting unit, said detecting unit connecting to said signal T/R unit to transfer detected signals to said signal T/R unit;

at least one warning unit, said warning unit connecting to said signal T/R unit, said warning unit showing signals received from said signal T/R unit;

an indoor power unit connecting to said power I/O module; and an emergency power unit connecting to said power I/O module.

2. The fire-alarm control panel according to claim 1, wherein said single-chip control module comprises an input unit, an output unit, a control unit, a communication interface and a relay.

3. The fire-alarm control panel according to claim 2, wherein said control unit is a 8051 single chip.

4. The fire-alarm control panel according to claim 2, wherein said control unit comprises a working frequency of 16 megahertz.

5. The fire-alarm control panel according to claim 1, wherein said communication interface is an RS232 interface.

6. The fire-alarm control panel according to claim 1, wherein said power carrier module comprises a transferring rate of 1200 BPS (bit per second).

7. The fire-alarm control panel according to claim 1, wherein said detecting unit connecting to said main signal control panel comprises at least one detector and at least one manual alarm unit.

8. The fire-alarm control panel according to claim 1, wherein said detecting unit further comprises a repeater located between said detector and said main signal control panel.

9. The fire-alarm control panel according to claim 1, wherein said warning unit comprises a main audio device, a local audio device and an alarming light.

10. The fire-alarm control panel according to claim 1, wherein said indoor power unit comprises a plug for indoor power.

* * * * *